US006070351A

United States Patent [19]

Verret

[11] Patent Number: 6,070,351

[45] Date of Patent: Jun. 6, 2000

[54] FLEXIBLE FACE SIGN WITH RAISED DISPLAY SURFACE

[76] Inventor: Normand Verret, 745 rue Canada, Edmundston, New Brunswick, Canada, E3V 1W3

[21] Appl. No.: 09/266,121

[22] Filed: Mar. 10, 1999

Related U.S. Application Data

[63] Continuation of application No. 09/138,541, Aug. 24, 1998.

[51] Int. Cl.[7] ..... G09F 17/00

[52] U.S. Cl. ..... 40/603; 160/378

[58] Field of Search ..... 40/603, 549, 571; 160/327, 328, 378, 352

[56] References Cited

U.S. PATENT DOCUMENTS

| | | | |
|---|---|---|---|
| 4,169,327 | 10/1979 | Stilling | 40/549 |
| 4,185,408 | 1/1980 | Tracy | 40/564 |
| 4,265,039 | 5/1981 | Brooks | 40/603 |
| 4,372,071 | 2/1983 | Vicino | 40/603 X |
| 4,488,368 | 12/1984 | Coleman | 40/549 X |
| 4,692,847 | 9/1987 | Gandy . | |
| 4,817,655 | 4/1989 | Brooks . | |
| 5,044,102 | 9/1991 | Finch et al. | 40/603 |
| 5,301,447 | 4/1994 | Lotter et al. | 40/603 |
| 5,577,830 | 11/1996 | Barry et al. . | |

*Primary Examiner*—Joanne Silbermann
*Attorney, Agent, or Firm*—Mario D. Theriault

[57] ABSTRACT

A sign that has side-framing members defining a sign opening and a flexible face material anchored to the side-framing members and stretched across the sign opening. A plurality of spaced apart flexible, resilient and transparent prop members are affixed to the side-framing members with the free end of each prop member extending against the back side of the flexible face material. Each prop member extends in a flexed mode against the flexible face material for resiliently raising the flexible face material from a plane of the sign's opening, for forming decorative architectural relief therein, and for maintaining the flexible face material in a stretched mode for a better appearance under a variety of sign conditions.

12 Claims, 6 Drawing Sheets

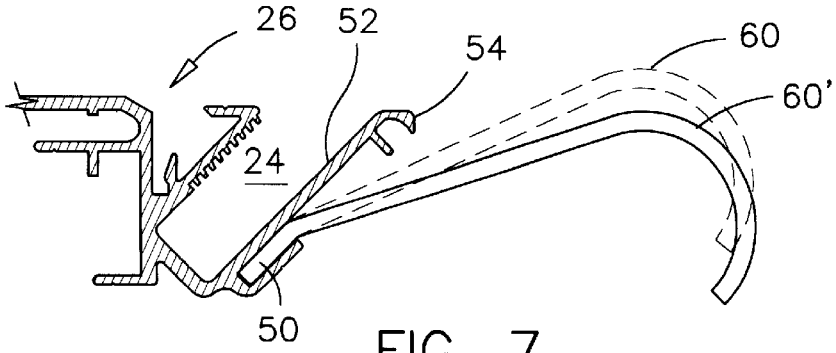
FIG. 7
FIG. 8
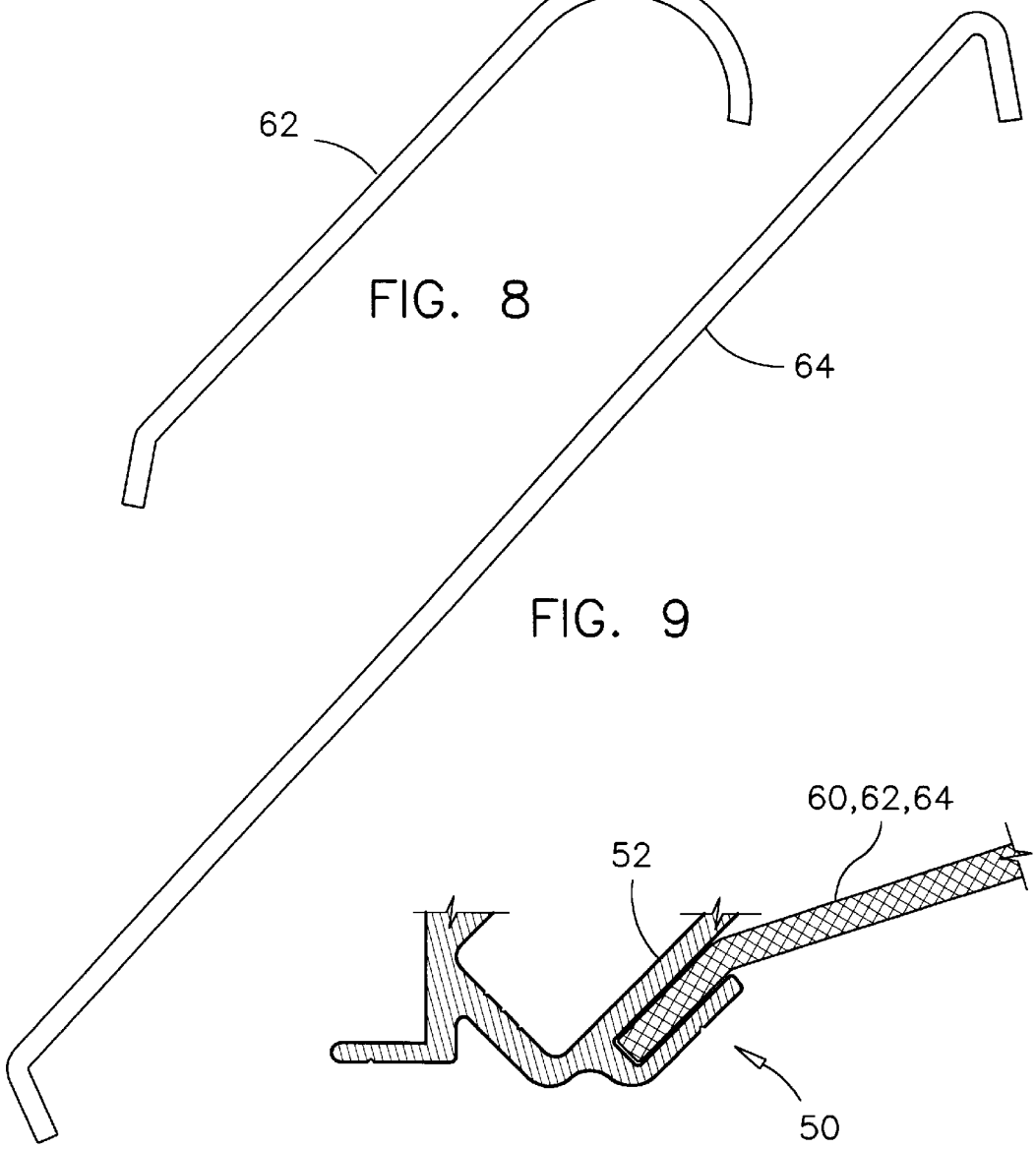
FIG. 9
FIG. 10

FLEXIBLE FACE SIGN WITH RAISED DISPLAY SURFACE

This is continuation of U.S. patent application Ser. No. 09/138,541, filed on Aug. 24, 1998.

FIELD OF THE INVENTION

The present invention relates to flexible face signs, and more particularly it relates to a flexible face sign having a raised display surface.

BACKGROUND OF THE INVENTION

A conventional flexible face sign has a planar display surface and a flexible face material that is stretched across an opening defined by the sign's framing members. The flexible face material is stretched by means of a plurality of flex holders affixed at spaced intervals to the perimeter thereof and to the framing members. These signs are described in details in U.S. Pat. Nos. 5,255,459 and 5,669,166 issued on Oct. 26, 1993 and Sep. 23, 1997 respectively, to the inventor of the present invention.

Conventional flexible face signs are primarily used as facade signs on buildings and around canopies of service stations. The flexible face materials on these signs are normally painted or decorated with adhering decals, stripes or lettering material.

While a raised surface on a flexible face sign is seldom used, there are some relevant structures in the prior art that have been developed and used with varying degrees of success.

A first example of a flexible face sign having a raised display surface is illustrated in U.S. Pat. No. 4,185,408 issued on Jan. 29, 1980 to Charles H. Tracy. This document sets forth a back-lighted signboard in which the sign face is stretched over a transparent convex panel. The transparent convex panel is affixed to the sign by a framing system integrated with the sign structure. The curvature of the transparent convex panel allows for a better illumination of the sign's display area, especially when this sign has a very large display surface.

Another example of a flexible face sign having a raised sign surface is described in U.S. Pat. No. 4,265,039 issued on May 5, 1981 to Jackson R. Brooks. In one of the illustrated embodiments, the flexible sign face has a 'molded pan look'. The raised shape is obtained by supporting the flexible face material outside the plane of the sign's opening by means of a continuous curved metallic strip extending from the periphery of the sign frame under the flexible face material.

A further example of a raised surface on a display sign is shown in U.S. Pat. No. 5,044,102 issued on Sep. 3, 1991 to W. Dennis Finch et al. In this installation, the flexible face material is installed taut over a fabricated grill-like tubular structure affixed across the opening of the sign. In this installation, a plurality of springs are used to pull on a rod mounted in a hem along the edges of the face material to stretch the sign face over the tubular structure.

Of course, raised display surfaces are also found in awning assemblies, in which a decorated fabric material is stretched over a raised tubular frame. Examples of awnings used as advertisement display signs are illustrated and described in the following U.S. Patents:

U.S. Pat. No. 4,817,655 issued on Apr. 4, 1989, to Jackson R. Brooks;

U.S. Pat. No. 4,692,847 issued on Sep. 8, 1987 to James Gandy;

U.S. Pat. No. 5,577,830 issued on Nov. 26, 1996 to Martin Berry et al.

In the advertising industry, it is believed that it is important to periodically change a sign to display a new business image, a new line of products or to simply rejuvenate a displayed message. Therefore, it is believed that the display surface of a sign should be easily replaceable without having to modify the basic structure of the sign. It is also believed that a sign appearance should be changeable from a flat to a raised configuration or vice-versa without having to replace the entire sign structure. Further, it is believed that a sign structure should have tensioning means for properly stretching flexible face materials of various widths, for anchoring for example, the face material of a sign that is changed from a flat configuration to a raised configuration.

The sign structures of the prior art are believed to be deficient at least one of the above preferred requirements, and it is this reason basically that has contributed to the development of a market demand for a new and improved sign structure capable of providing three-dimensional visual effects to flexible face sign, while being easily built in various sizes, shapes and being easily modifiable to adapt to changing styles.

SUMMARY OF THE INVENTION

The sign system of the present invention offers a new concept for raising the flexible face of a sign and to form therein various architectural reliefs that are believed to be important visual innovations in the sign industry.

Broadly, in accordance with one feature of the invention, there is provided a flexible face sign comprising a plurality of side-framing members defining a sign opening, and a flexible face material anchored to the side-framing members and stretched across the sign's opening. The flexible face material has a display side and a back side. There is also provided a plurality of spaced apart flexible and resilient prop members each having a fixed end affixed to one of the side-framing members, and a free end extending against the back side of the flexible face material. The free end of each prop member is in a stressed mode and acting against the flexible sign face material for resiliently raising the flexible face material from a plane of the sign's opening.

A major advantage of the structure of the present invention is that decorative architectural reliefs are formable in the flexible face material for improving the visual properties of the sign while the flexible face material is maintainable in a stretched mode for a better appearance under a variety of sign conditions.

In another aspect of the present invention, there is provided a flexible face sign comprising a plurality of side-framing members defining a sign opening and each having a slot therein pointing away from the sign opening. A plurality of spaced-apart C-shaped framing members are connected to the side-framing members for maintaining the side-framing members in a fixed relationship with each other along the sign's opening. A flexible face material is removably anchored to the side-framing members and is stretched across the sign's opening. The flexible face material has a display side and a back side. The flexible face sign also has a plurality of spaced apart flexible and resilient prop members each having a fixed end removably affixed to the slot in one of the side-framing members, and a free end extending in a flexed mode against the back side of the flexible face material for resiliently raising the flexible face material from a plane of the sign's opening.

The fact that the flexible face material is removably anchored to the side-framing members is particularly advantageous for opening the sign casing for maintenance for example, in a manner that is customary with conventional flexible face signs.

Furthermore, the fact that the flexible prop members and the flexible face material are removably mounted to the side-framing members is also particularly appreciable for periodically renewing the sign's appearance at minimum expense to the owner of the sign.

According to yet another feature of the present invention, there is provided a flexible face sign having a base, a plurality of side-framing members connected to the base and defining opposite sides of the sign. Each side-framing member has a first and second spaced-apart slots therein and each slot is pointing away from the base. The flexible face sign also has a plurality of spaced-apart flexible and resilient prop members each having a first and second anchor members respectively connected to the first and second slots. Each prop member has a dilated shape extending away from the base and defining a partial profile of the sign. A flexible face material is removably anchored to the side-framing members and is stretched over the dilated shapes, with each prop member being in a flexed and stressed mode.

The advantages of this latter feature are basically that the described dilated shapes are usable for forming a variety of non-conventional sign shapes, and the flexible face material is maintainable in a stretched mode over these sign shapes and under a variety of sign conditions.

Still another feature of the invention is that it is susceptible of a low cost of manufacture with regard to materials, equipment and labour, and which accordingly is then susceptible of low price of sale to the industry, thereby making such sign structure economically available to the public.

BRIEF DESCRIPTION OF THE DRAWINGS

One embodiment of this invention is illustrated in the accompanying drawings, in which like numerals denote like parts throughout the several views, and in which:

FIG. 7 is a partial cross-section view of a side-framing member of the sign casing according to the first and second preferred embodiments with a flexible prop strip of a first type affixed thereto;

FIG. 8 is a cross-section view of a flexible prop strip of a second type;

FIG. 9 is a cross-section view of a flexible prop strip of a third type;

FIG. 10 is an enlarged view of the engagement of a flexible prop strip in the slot of a side-framing member;

DETAILED DESCRIPTION OF THE PREFERRED EMBODIMENTS

Figure 1:
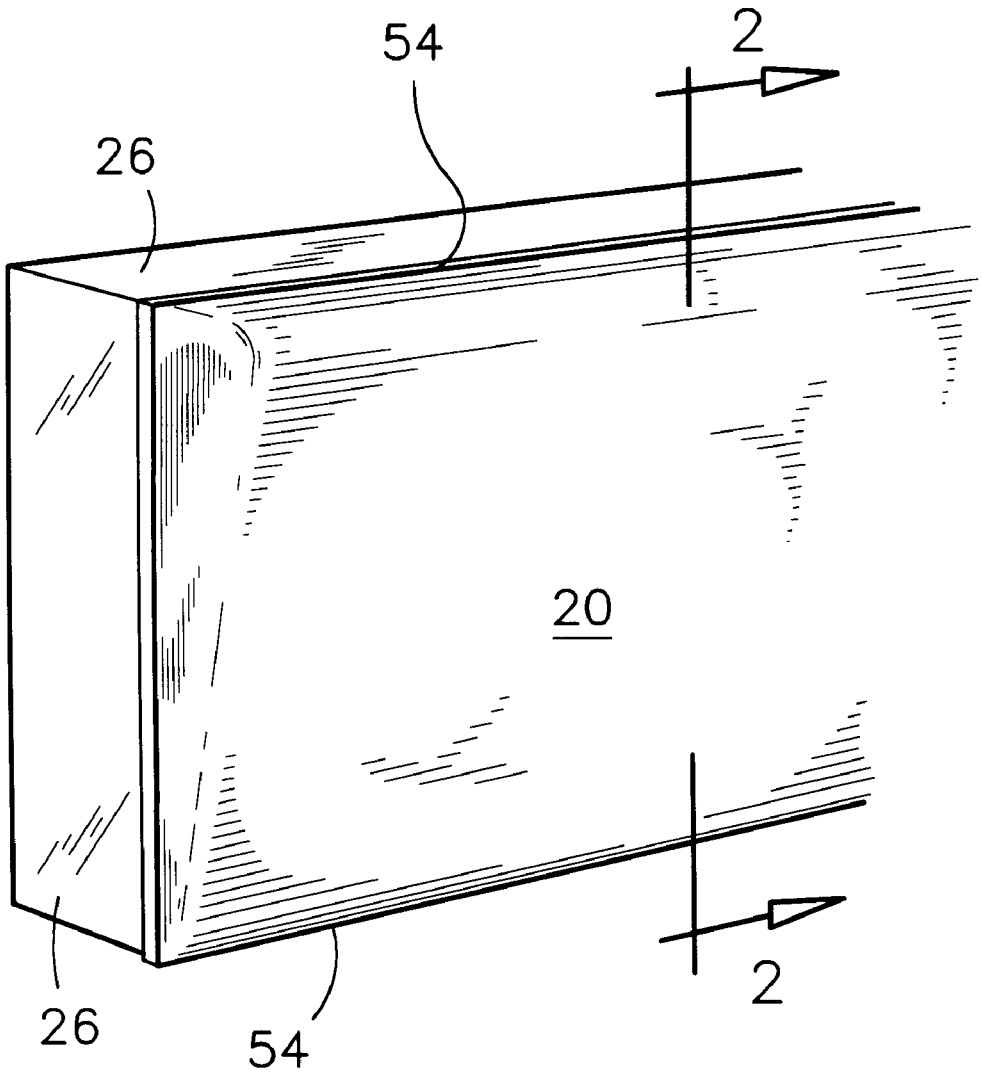
FIG. 1 is a perspective view of a sign having a raised display surface, according to a preferred embodiment of the present invention.

While this invention is susceptible of embodiments in many various forms, there are shown in the drawings and will be described in details herein four specific embodiments, with the understanding that the present disclosure is to be considered as example of the principles of the invention and is not intended to limit the invention to the embodiments illustrated.

Sign designers and manufacturers in general are always striving to obtain pleasing appearance for their clients' signs. The variations in appearance in flexible face signs have traditionally been limited to the artistic quality of the displayed message and background, and in the originality in the contour of the sign. Generally, little progress has been made in the past to change the relief of the display surface. The sign systems of the preferred embodiments offer new structures and methods for improving the appearance of a sign while maintaining the advantages of working with flexible face material.

Figure 2:
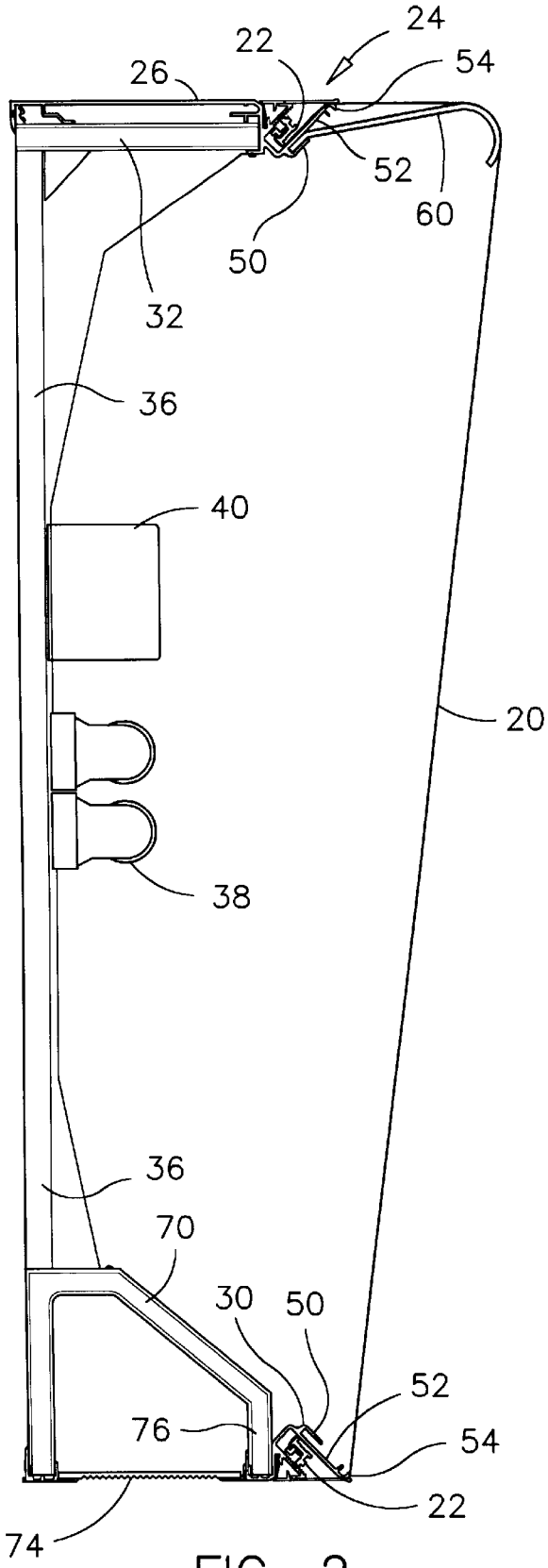
FIG. 2 is a cross-section view of a sign according to a preferred embodiment of the present invention, as viewed along line 2—2 in FIG. 1 and wherein the display surface is forwardly slanted, and incorporates a down-lit portion.

Referring to FIGS. 1–6 in the drawings, there are illustrated therein four variants of flexible face signs having raised display surfaces. FIGS. 1–2 in particular illustrate a flexible face sign according to the first preferred embodiment of the present invention. The flexible face material 20 is stretched across the opening defined by the frame of the sign, by means of a plurality of flex holders 22 which are affixed to the border of the flexible face material 20 and are engaged into slots 24 along the side-framing members 26 of the sign.

The sign casing according to the first preferred embodiment is a full face sign wherein the non-illuminated portion thereof is limited to the sides and top portion of the casing. The side-framing member 26 surrounding the sign display area is referred to in the sign industry as a frameless extruded member 26, or a frameless extrusion.

Referring especially to FIG. 2 with reference to FIGS. 11–16, the sign structure according to the preferred embodiments are manufacturable with modular components. Hence, a sign is easily built in-place with standard parts, or sold in kit form with a rolled-up flexible sign face having custom dimensions and pre-made markings.

The side-framing members 26, 28 and 30 for examples, are preferably manufactured in three different widths for manufacturing sign casings of various depths. The side-framing members 26,28,30, are usable with L-shaped framing members 32 and hollow tubular members 36 for forming the skeletal structure of a sign casing. Each L-shaped framing member 32 has a stem 34 that is mountable inside the tubular member 36, and is usable with the tubular members 36, for making C-shaped framing members that are preferably installed at intervals of between 36 and 48 inches along the sign casing. The lamps 38 and ballast 40 of the sign are preferably attached to these tubular members 36.

The frameless extruded members 26,28,30, each has a first serrated slot 24 for receiving and holding the flex holders 22 as previously explained. There is also provided on these frameless extruded members, a second slot 50 adjacent the first slot 24 and sharing a common wall 52 with the first slot 24. A cross-section of the second slot 50 defines a rectangular cavity having a longer side pointing away from a central region of the sign casing and toward the edge 54 of the sign face.

The raising of the flexible face material 20 in the sign according to the first preferred embodiment is obtained by mounting a number of flexible and resilient prop strips 60 of a first type, between the flexible face material 20 and the frameless extruded member 26, along the length of a sign casing. Each prop strip 60 has a fixed end removably mounted in the second slot 50 and a free end acting against the back side, or the inside surface of the flexible sign face material, for raising the sign face material. In the case of the sign illustrated in FIG. 2, the flexible sign face material is raised along the upper edge of the sign.

Each prop strip 60 is made of transparent or translucent material. Each prop strip 60 is also made of a flexible and resilient material that has a preferred thickness of between about 3/16 inch and about 1/4 inch and a preferred width of between about 2 inches and about 4 inches. The preferred spacing between two juxtaposed strips 60 is between about 12 inches and about 24 inches, although full-length prop strips are also usable.

Some types of flexible, resilient and transparent sheet material usable for manufacturing the prop strips are plastic materials known in the sign industry under the trade names LEXAN™ and PLEXIGLAS™.

The prop strips of the first type 60 are used for shaping a rounded upper edge on the sign face 20 and for inclining the sign face such that the advertisement material displayed thereon is easily read from relatively short distances below the sign.

Another advantage of the raised display surface of the flexible face sign of the first preferred embodiment is that the overall thickness of the sign may be reduced as compared with the conventional sign casings while maintaining an ideal distance between the lamps 38 of the sign and the flexible face 20. The raised surface of the sign of the first preferred embodiment allows for a compact design with very good illumination characteristics.

It will also be appreciated that the raised sign surface of the sign according to the first preferred embodiment offers an improved appearance when compared to conventional flat display surfaces, and this improvement is available while maintaining the frameless feature of the sign.

During the installation of the flexible sign face 20 in a raised configuration, it is recommended to flex or otherwise pre-stress the prop strips down a certain extent as shown at 60–60' in FIG. 7. By doing so, the prop strips 60 provide additional tensioning force to the flexible face material 20 for pushing the flexible face material upwardly and outwardly and for compensating for a limited adjustment range of the flex holders 22 in the serrated slots 24 for example. The flexible face material is thereby always properly taut and has a smooth appearance.

The prop strips 62,64 of the second and third types, as shown in FIGS. 8 and 9, are also mountable in the slot 50 of a side-framing member 26, according to the described manner. Each prop strip 60,62 or 64 has a free end that is extending away from the slot 50 and that is usable for shaping the flexible face material and for resiliently supporting and tensioning the flex face material 20. This additional tensioning of the flexible face material is also appreciable for maintaining the tension in a flexible face material in windy conditions, under intense heat, or simply on an aging sign installation.

Figure 15:
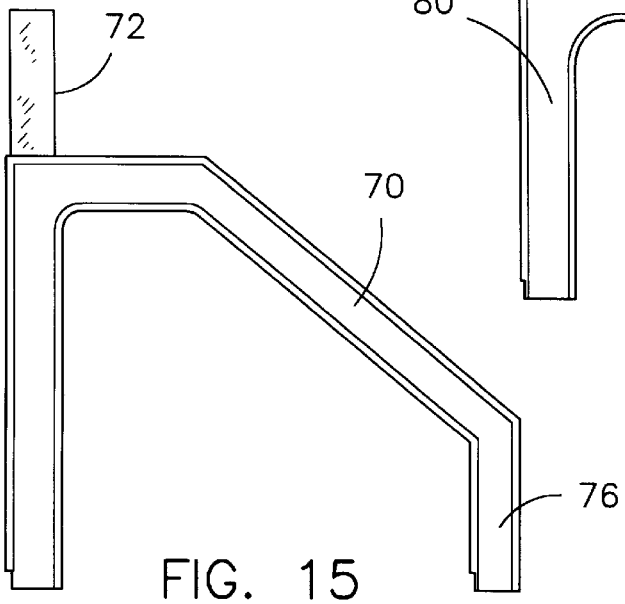
FIG. 15 is a side view of a h-shaped framing member usable for manufacturing signs according to the first preferred embodiment.

In the embodiment illustrated in FIG. 2 with reference to FIG. 15, there is provided a h-shaped framing member 70 that has a stem portion 72 having a shape and a size for engagement inside the tubular member 36. One h-shaped framing member is preferably installed on each tubular member 36. As illustrated, one leg 76 of each h-shaped framing member 70 is used for supporting a narrow-width side-framing member 30. A transparent lens 74 may be conveniently installed between the legs of the h-shaped framing member 70 for providing a down-lit feature on this sign.

Figure 3:
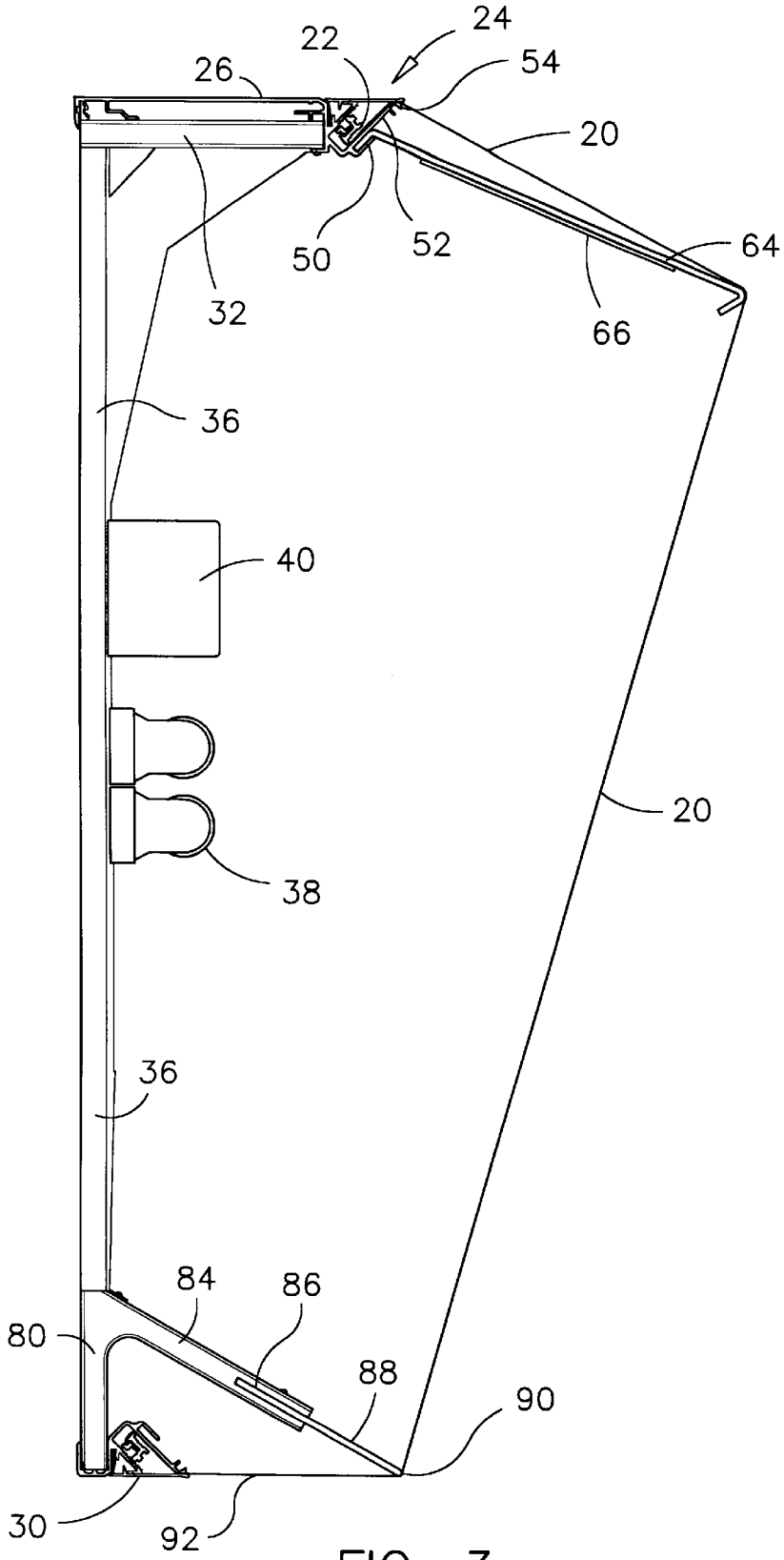
FIG. 3 illustrates a cross-section view of a sign according to a second preferred embodiment, having a raised and forwardly slanted front display surface and illumination in forward and down directions.

Referring now to FIGS. 3 and 9, the illustrations show the structural details of a raised surface sign wherein the forward display surface is inclined forwardly by a series of prop strips 64 of the third type. Here again, the flexible sign face material 20 is preferably installed while flexing and pre-stressing the prop strips 64 downward a certain extent for providing additional tensioning forces under the flexible face material 20, and for obtaining all the aforesaid advantages. The prop strips 64 of the third type are used for further inclining the forward display surface of the sign and for shaping a crease along the upper region of the sign face.

When the prop strip 64 is a continuous strip extending the full length of the sign, a layer of tinted film 66 may be affixed to the strip 64 for projecting various shades on the flexible face material 20. Adhesive film material which is appropriate for this application is known in the sign industry under the trade name of SCOTHCAL™. This product is manufactured by 3M, a company which is known worldwide.

Figure 14:
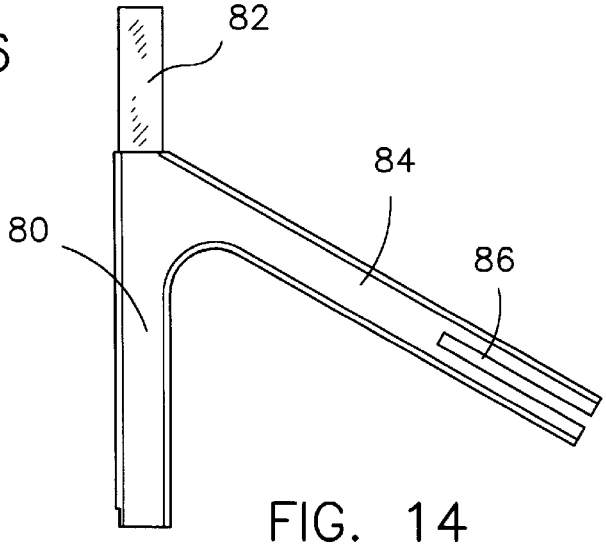
FIG. 14 is an inverted side view of a Y-shaped framing member usable for manufacturing signs according to the second, third and fourth preferred embodiments of the present invention.

The modular components for manufacturing the signs according to the preferred embodiments, also comprises a Y-shaped framing member 80 as illustrated in FIG. 14. This particular framing member also has a stem 82 for engagement inside the end of a tubular member 36, for use with the tubular member 36 for framing the lower side of a sign casing for example. In the illustrated embodiment, the slanted leg 84 of the Y-shaped framing member 80 has a slot 86 therein for receiving and holding for example, a flat bar or strip 88 of transparent or translucent material. The strip 88 is used for forming a lower edge 90 of the display surface of the sign, wherein the flexible face material 20 is anchored to the upper edge of the sign casing and wraps around the forward and lower portions of the sign casing.

The use of the Y-shaped framing member 80 is advantageous for manufacturing raised display surfaces extending over the forward portion of a sign and over a down-lit portion 92 extending at substantially a right angle with the forward portion as illustrated in FIG. 3. It will be appreciated that this flat bar 88 is also usable for shaping numerous types of adjacent non-parallel surfaces on the display area of a sign.

It will also be appreciated that because the Y-shaped framing members 80, and the h-shaped framing members 70 are installed at distances from each other, the down-lit section 74 and the lower display surface 92 are fully lit when the lights 38 of the particular described sign are on.

It will be appreciated that although the prop strips 60,62 and 64 have been illustrated as being mountable along the upper edge of a rectangular sign casing, the described installations apply to both the upper and lower edges of the sign casing as well as to the ends of the sign casing. It will be appreciated that the described installations also apply to double-faced signs and curved-contour signs.

In view of the above description, it will also be appreciated that a display surface and the architectural relief on a sign may be renewed entirely by simply replacing the flexible face material and a series of prop strips, without modifying the original structure of the sign. It will be appreciated that this is a substantial economy in material and installation time for the owner of the sign.

Figure 4:
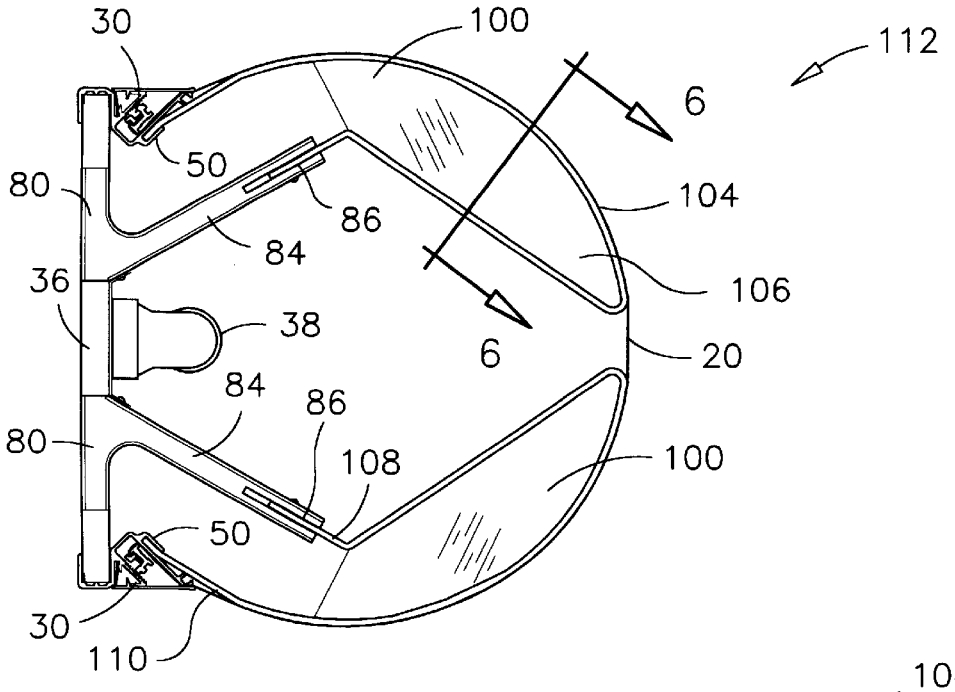
FIG. 4 is a cross-section view of a sign according to a third preferred embodiment, having a cylindrical display surface.
Figure 6:
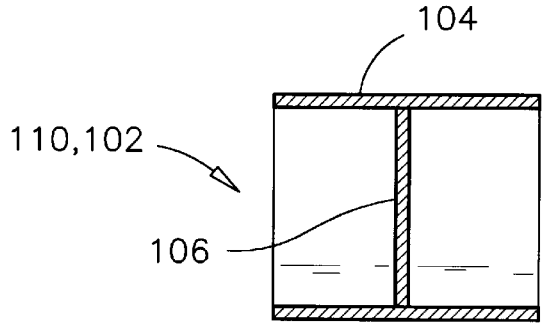
FIG. 6 is a cross-section view of a flexible transparent truss-like prop member usable for supporting a flexible sign face, as seen along line 6—6 in FIG. 4.
Figure 5:
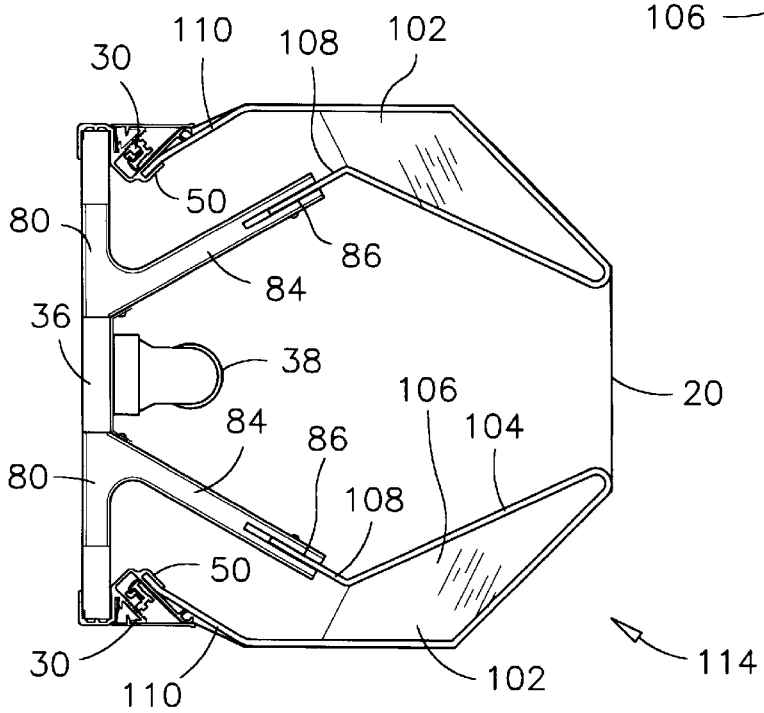
FIG. 5 is a cross-section of a sign according to a fourth preferred embodiment, having a prismatic display surface.
Figure 11:
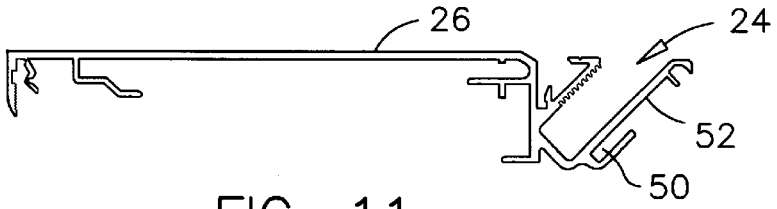
FIG. 11 is a cross-section view of a wide extrusion usable as a side-framing member for manufacturing signs according to the preferred embodiments.
Figure 12:
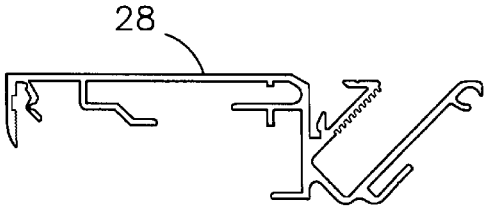
FIG. 12 is a cross-section view of a medium-width extrusion usable as a side-framing member for manufacturing signs according to the preferred embodiments.
Figure 13:
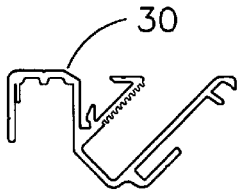
FIG. 13 is a cross-section view of a narrow extrusion usable as a side-framing member for manufacturing signs according to the preferred embodiments.
Figure 16:
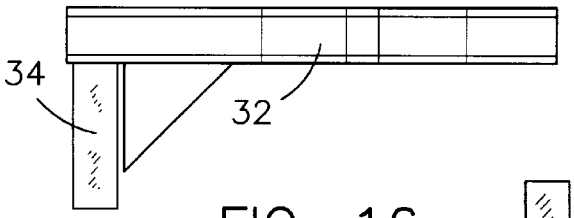
FIG. 16 is an inverted side view of a L-shaped framing member usable for manufacturing signs according to first and second preferred embodiments of the present invention.

Referring now to FIGS. 4–6, the Y-shaped framing members 80 are usable for constructing a sign base 30,36,80 on which a variety of different sign shapes may be built. As examples of the sign shapes that are manufacturable on such a sign base, FIGS. 4 and 5 illustrate respectively a cylindrical shape and a prismatic shape.

Each Y-shaped framing member 80 is usable for retaining a truss-like prop member 100 or 102 having two attachment points. The truss-like prop members 100 and 102 are usable for installation in an overhung mode for supporting a flexible face material that is mounted at a substantial distance from the mounting structure 36. Each of the truss-like prop members 100, 102 has a dilated shape in which the outside segment defines a portion of a sign profile. When mounted in pairs, with the inside segments thereof facing one-another, their outside segments define the entire sign profile, as illustrated in FIGS. 4 and 5.

Each of the prop members 100,102 is made of flexible and transparent or translucent plastic material, and comprises a fixed end, a free end, a flange member 104 and web member 106 affixed to the flange member for stiffening the flange member 104. The fixed end has two anchor portions 108,110 that are respectively connectable to the slot 86 of the Y-shaped framing member 80 and to the slot 50 of a side-framing member 30.

It will be appreciated that the anchor portions 108,110 have sufficient length, flexibility and resiliency for being initially deformable as described for the previously mentioned prop strips 60,62,64, for the purpose of maintaining the flexible face material 20 under tension.

In use, it is recommended to affix the anchor portions 108,110 to the side-framing member 30 and to the Y-shaped framing member 80, with screws (not shown) through the slot 50 of the side-framing member 30 and through the slot 86 of the slanted leg 84.

These truss-like prop members 100,102 have been found to be advantageous for making relatively thick signs, such as the cylindrical sign 112 illustrated in FIG. 4 and the prismatic shape 114 illustrated in FIG. 5. These sign structures are believed to be important innovations in the field of flexible face signs.

Only three broad types of flexible prop members have been illustrated herein. The description is therefore not exhaustive and those knowledgeable in the art will appreciate that many more shapes of signs are possible with the information provided herein, and are limited only by ones imagination.

As to other specific dimensions, to other manner of manufacturing and of using the flexible face signs of the present invention, the same should be apparent from the above description, and accordingly, no further discussion relative to these aspects is provided.

While four embodiments of the present invention have been illustrated in the accompanying drawings and described herein above, it will be appreciated by those skilled in the art that various modifications, alternate constructions and equivalents may be employed without departing from the true spirit and scope of the invention which is defined by the appended claims.

I claim:

1. A flexible face sign comprising:

a plurality of side-framing members defining a sign opening, an edge around said sign opening, a plane of said sign opening, and inside and outside regions of said sign opening relative to said edge; each of said side-framing members having face-material retention means mounted therealong around said sign opening and a rectangular slot disposed adjacent said face-material retention means in said inside region of said sign opening, said rectangular slot having a rectangular cross-section and a longer cross-sectional dimension making an angle with said plane of said sign opening;

a plurality of structural framing members connected to said side-framing members for maintaining said side-framing members in a fixed relationship with one-another around said sign opening;

a flexible face material affixed to said face-retention means and stretched across said sign opening; said flexible face material having a display side and a back side; and a plurality of spaced apart flexible and resilient prop members each having a fixed end removably affixed to said rectangular slot, and a free end extending against said back side of said flexible face material at a distance from said edge around said sign opening; said free end being in a flexed mode and acting against said back side for resiliently raising said flexible face material from said plane of said sign opening;

such that architectural reliefs are formable in said flexible face material for improving a visual characteristic thereof while said flexible face material is maintainable in a stretched mode under a variety of sign conditions, and said prop members and said flexible face material are removable from said side-framing members for periodically changing said flexible face material and said reliefs.

2. The flexible face sign as claimed in claim 1, wherein said sign opening comprises a forward display portion and a down-lit portion extending substantially at a right angle with said forward display portion.

3. The flexible face sign as claimed in claim 1, wherein each of said prop members comprises a flat bar affixed to said structural framing members; said flat bar having a lateral dimension extending through said plane of said sign opening.

4. The flexible face sign as claimed in claim 1, wherein each of said structural framing members is a C-shaped framing member which comprises a straight tubular member and a L-shaped member having a stem engaged in said straight tubular member.

5. The flexible face sign as claimed in claim 1, wherein said face-material retention means comprises a serrated slot sharing a common wall with said rectangular slot.

6. The flexible face sign as claimed in claim 5, wherein said common wall defines said edge around said sign opening.

7. The flexible face sign as claimed in claim 1, wherein each of said prop members is a strip of flexible and resilient material.

8. The flexible face sign as claimed in claim 7, wherein each said strips has a width of between about 2 inches and about 4 inches, and a thickness of between about 3/16 inch and about 1/4 inch.

9. The flexible face sign as claimed in claim 7, wherein said strips are spaced apart distances of between about 12 inches and about 24 inches.

10. The flexible face sign as claimed in claim 7, wherein said strips are made of translucent plastic material.

11. The flexible face sign as claimed in claim 10, wherein each of said strips has a tinted film affixed thereto.

12. The flexible face sign as claimed in claim 1, wherein each of said side-framing members is a frameless extruded member.

* * * * *